US005894927A

United States Patent [19]

Bennett

[11] Patent Number: 5,894,927

[45] Date of Patent: Apr. 20, 1999

[54] DISPENSER FOR APPLICATOR PADS

[75] Inventor: Robert Bennett, Easton, Conn.

[73] Assignee: Chesebrough-Pond's USA Co., Division of Conopco, Inc., Greenwich, Conn.

[21] Appl. No.: 08/871,309

[22] Filed: Jun. 9, 1997

[51] Int. Cl.[6] ..... B65D 75/00

[52] U.S. Cl. ..... 206/438; 206/233; 206/493; 206/804

[58] Field of Search ..... 206/438, 303, 206/233, 493, 494, 449, 451, 804, 817

[56] References Cited

U.S. PATENT DOCUMENTS

| | | | |
|---|---|---|---|
| 1,191,165 | 8/1916 | Eisenhardt | 206/804 |
| 1,800,459 | 4/1931 | Maclean | 206/303 |
| 2,252,381 | 8/1941 | Ladd | 206/804 |
| 2,281,251 | 4/1942 | Simmons | 206/804 |
| 4,432,451 | 2/1984 | Hooser | 206/804 |
| 4,765,482 | 8/1988 | Delia | 206/804 |

*Primary Examiner*—Paul T. Sewell
*Assistant Examiner*—Jila Mohandesi
*Attorney, Agent, or Firm*—Milton L. Honig

[57] ABSTRACT

An applicator pad dispensing container is provided having a jar, a cap to close the jar and a piston assembly movable within the jar. The piston assembly includes a platform with a rod projecting from an upper surface thereof terminating in a head. A stack of applicator pads, each with a central aperture, can be loaded onto the platform with the rod penetrating the aperture to securely hold the pads. The head engages a hollow socket in an under surface of the cap. Engagement of head and cap allows the platform with pads to be raised to a top position whereupon the cap can twistably be released from the head. After a pad(s) is removed, the cap can snap onto the head and with downward pressure return the platform with remaining pads back into the jar.

15 Claims, 2 Drawing Sheets

DISPENSER FOR APPLICATOR PADS

BACKGROUND OF THE INVENTION

1. Field of the Invention

The invention concerns a dispenser for storing and delivering in pop-up fashion a multiplicity of applicator pads.

2. The Related Art

Screw-cap wide-mouthed jars have long been used as packaging for stacks of applicator pads. These pads have cosmetic and medical uses. They may be utilized as coverings for wounds or impregnated with antiseptic chemicals for skin wiping purposes. As cosmetics, these pads are known for use as make-up removers, cleansers or vehicles to apply leave-on cosmetics (e.g. anti-wrinkle or anti-acne compositions). Especially when impregnated with chemicals, the pads can be quite messy to handle. This is particularly a problem when attempting to extract a single applicator from within the bottom of a deep jar when a majority of the stack has already been removed. Additionally, in many instances it is desirable if not required that contamination of the stack and sides of the jar be avoided.

Accordingly, it is an object of the present invention to provide an applicator pad dispensing jar which minimizes contamination from a user's fingers.

Another object of the present invention is to provide an applicator pad dispensing jar from which the pads can readily be viewed and removed.

Other objects of the present invention will become more apparent from consideration of the following summary and detailed description.

SUMMARY OF THE INVENTION

An applicator pad dispensing container is provided which includes:

(i) a jar with an open mouth;

(ii) a cap fitting over the open mouth, the cap on an under surface thereof including a hollow socket; and (iii) a piston assembly vertically movable within the jar, the piston assembly including a platform and a rod projecting from an upper surface of the platform, the rod having a head at an end thereof distant from the platform, the piston assembly being capable of receiving and supporting a stack of applicator pads, and the head being releasably engageable with the socket.

Walls forming the jar taper inwardly toward the open mouth. The jar best achieves it's taper through a blow molding process. In this process, walls of the blown structure are thinner downstream from entry point of the resin forming the molded object. High density polyethylene is the preferred material. An inwardly projecting ledge is formed in the walls of the jar adjacent the open mouth.

The platform includes an outer skirt flexibly resilient along a diameter of the platform. The outer skirt at a plurality of intervals is segmented by slits. Preferably there are three slits equidistantly located along the outer skirt. Further, the platform includes a base plate fashioned with a multiplicity of openings. At a center of the platform is a well for receiving and securing a second end of the rod. The second end has two legs lengthwise separated by a channel. An outwardly projecting wedge is formed on each leg. The well at a lower end is formed with a pair of undercuts structured to each detainably receive one of the two legs.

The head element at the end of the rod is preferably a round ball. However, it may also be oval or have a pyramidal wedge shape.

The hollow socket found in the cap is fashioned from resiliently flexible walls. An inwardly projecting ledge at an open end of the hollow socket is formed. The head of the piston assembly can lockingly engage the projecting ledge, yet can easily be disengaged through a sidewise pivot of the cap.

BRIEF DESCRIPTION OF THE DRAWINGS

The above features, advantages and objects of the present invention will be more fully appreciated through the following detailed discussion, reference being made to the drawing in which.

DETAILED DESCRIPTION OF THE INVENTION

Figure 2:
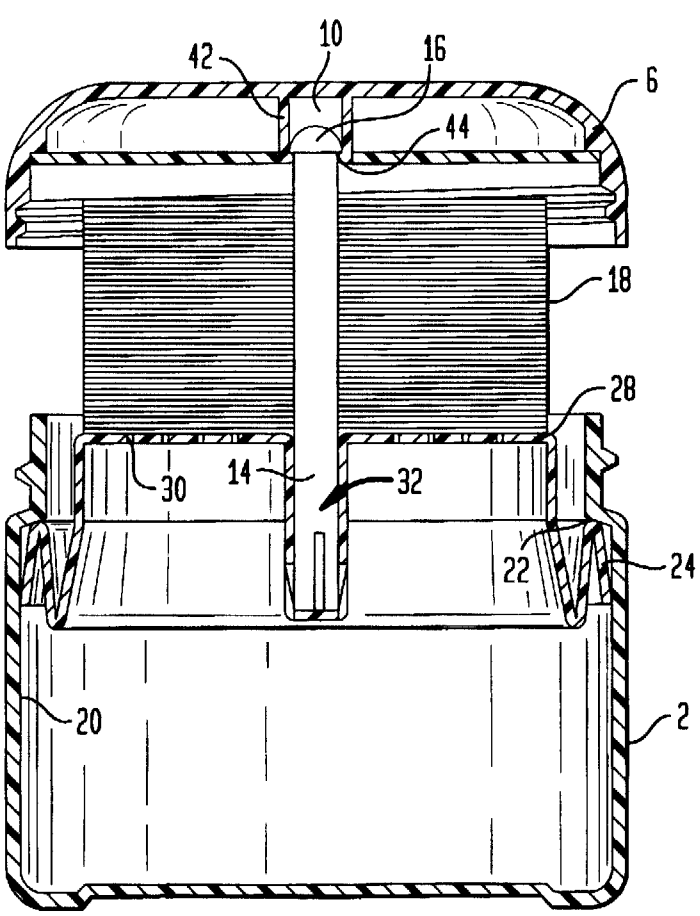
FIG. 2 is a cross sectional view along line 2—2 of FIG. 1, except with the cap attached to the piston assembly.
Figure 1:
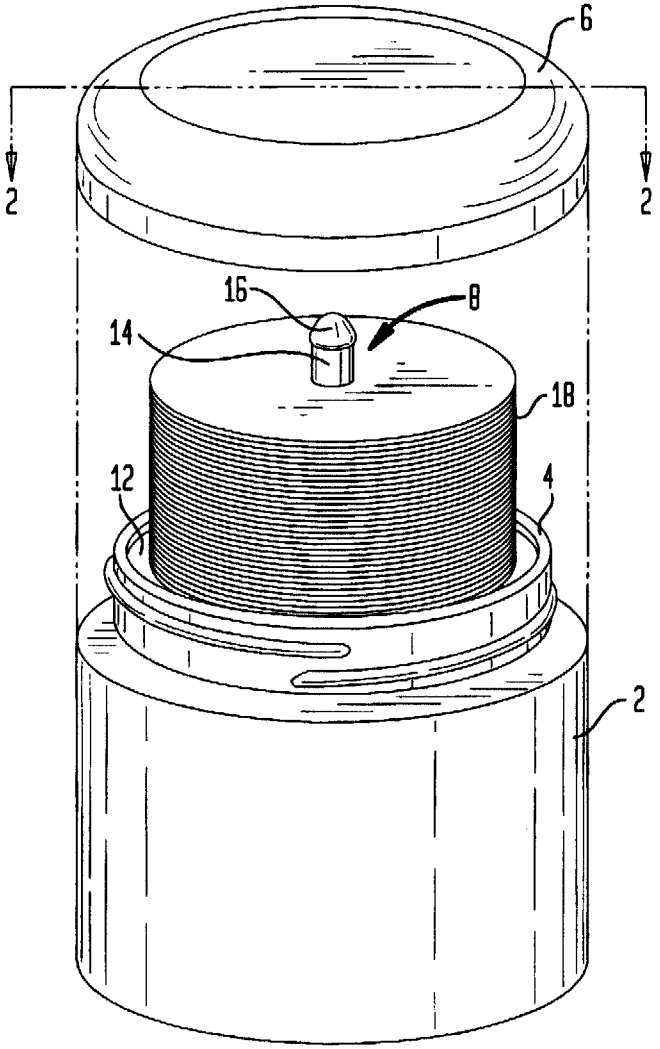
FIG. 1 is a plan perspective view of the dispensing container with cap removed and applicator pad stack in a raised position.

The dispensing container as shown in FIG. 1 includes a jar 2 with an open mouth 4, a cap 6 and a piston assembly 8. The cap fits over the open mouth in a screw thread fashion. On an under surface of the cap is a hollow socket 10 for receiving a part of the piston.

Piston assembly 8 includes a platform 12 and a rod 14, the latter projecting form an upper surface of the platform. A semi-circular head 16 is located at one end of the rod distant from the platform. Head 16 is releasably engageable with the hollow socket 10. Piston assembly 8 can receive and support a stack of applicator pads 18.

Inner walls 20 forming an interior of jar 2 taper inwardly toward the open mouth 4. Taper is achieved by producing the jar through a blow molding procedure. High density polyethylene is the preferred material for molding the jar. Near the open mouth, an inwardly projecting ledge 22 is circumferentially formed along walls of the jar.

Figure 4:
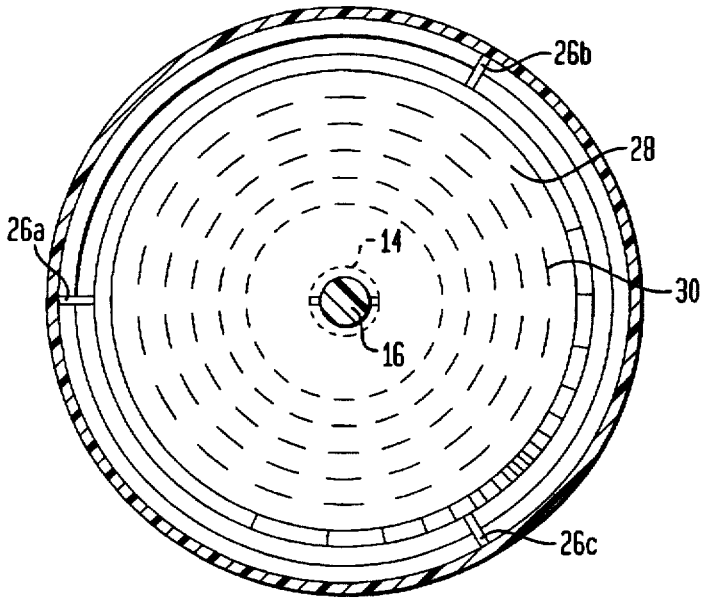
FIG. 4 is a top plan view taken along line 4—4 of FIG. 3.

The platform includes an outer skirt 24 flexibly resiliently along a diameter of the platform. FIG. 4 illustrates a series of three slots 26*a*, 26*b* and 26*c* cut into the outer skirt thereby segmenting it into three flexible sectors. Further, the platform includes a base plate 28 formed as a grating with a multiplicity of openings 30.

Figure 5:
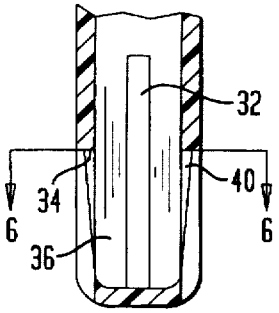
FIG. 5 is an expanded partial view of the platform well engaged with the second end of the rod.
Figure 6:
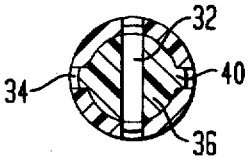
FIG. 6 is a cross section taken along line 6—6 of FIG. 5.
Figure 7:
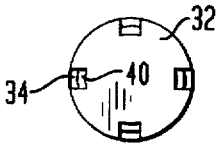
FIG. 7 is a bottom view of FIG. 5.
Figure 8:
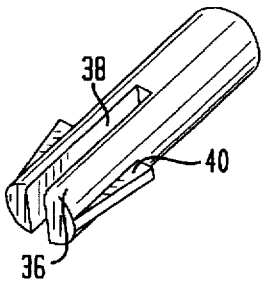
FIG. 8 is a perspective, expanded view of the second end of the rod.

A well 32 is formed at a center of the platform for receiving and securing a second end of rod 14. FIG. 5 and 6 illustrate the well which at a lower end is formed with a pair of undercuts 34. The second end of rod 14 is formed with two legs 36 lengthwise separated by a channel 38 and an outwardly projecting wedge 40 formed on each leg. FIG. 8 best illustrates the second end of the rod.

Figure 3:
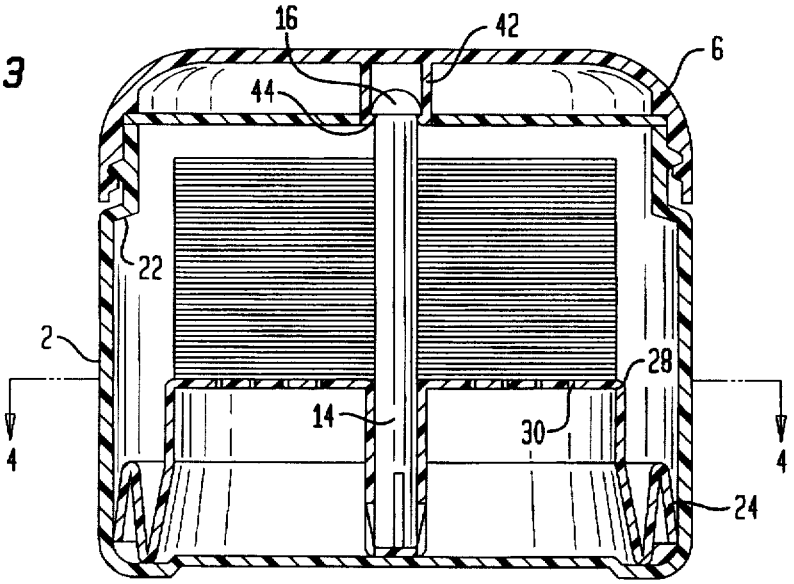
FIG. 3 is a cross sectional view similar to FIG. 2 except the applicator pad stack is in the storage position within the jar and the cap screwably seals the jar.

The hollow socket 10 of the cap is formed with resiliently flexible walls 42. Near an open end of the walls 42 is an inwardly projecting ledge 44. The piston through its head disengages from the hollow socket by angling the cap and applying a slight pulling force. Reattachment is achieved when, as in FIG. 3, the cap forces the piston assembly with applicator pad stack down into the jar. At the platform's lowest position, walls of the hollow socket in the cap are pressed outwardly by the head of the rod. When head 16 passes ledge 44, flexible walls 42 releasably capture the head. Although the head is shown as a round ball, it may also be an oval ball, a pyramidal wedge or any other polygonal structure so long as one of its diameters is larger than a diameter of the rod.

The foregoing description and drawing illustrate selected embodiments of the present invention and in light thereof various modifications will be suggested to one skilled in the art all of which are within the spirit and purview of this invention.

What is claimed is:

1. An applicator pad dispensing container comprising:

(i) a jar with an open mouth;

(ii) a cap fitting over the open mouth, the cap on an under surface thereof including a hollow socket having a projecting ledge formed at an open end of the socket; and (iii) a piston assembly vertically movable within the jar, the piston assembly including a platform and a rod projecting from an upper surface of the platform, the rod having a head at an end thereof distant from the platform, the piston assembly being capable of receiving and supporting a stack of applicator pads, and the head being releasably engageable with the ledge of the socket, engagement of the head with the socket allowing the platform with pads to be raised to a top position.

2. The container according to claim 1 wherein inner walls forming the jar taper inwardly toward the open mouth.

3. The container according to claim 2 wherein the inner walls of the jar are tapered through a blow molding process.

4. The container according to claim 1 wherein the jar is formed of high density polyethylene.

5. The container according to claim 1 wherein walls forming the jar adjacent the open mouth circumferentially form an inwardly projecting ledge.

6. The container according to claim 1 wherein the platform comprises an outer skirt flexibly resilient along a diameter of the platform.

7. The container according to claim 6 wherein the outer skirt has a plurality of intervals, each separated by a slot.

8. The container according to claim 7 wherein the outer skirt is fashioned with three slots.

9. The container according to claim 1 wherein the platform includes a base plate having a multiplicity of openings.

10. The container according to claim 1 wherein the platform at a center thereof includes a well for receiving and securing a second end of the rod.

11. The container according to claim 10 wherein the second end of the rod has two legs lengthwise separated by a channel and an outwardly projecting wedge formed on each leg.

12. The container according to claim 11 wherein the well at a lower end is formed with a pair of undercuts structured to each detainably receive one of the two legs.

13. The container according to claim 1 wherein the hollow socket of the cap is formed from resiliently flexible walls.

14. The container according to claim 1 wherein the head of the rod has a shape selected from the group selected of a round ball, an oval ball and a pyramidal wedge.

15. An applicator pad dispensing system comprising:

(a) a plurality of applicator pads, each having a central aperture; and (b) a dispensing container comprising:

(i) a jar with an open mouth;

(ii) a cap fitting over the open mouth, the cap on an under surface thereof including a hollow socket having a projecting ledge formed at an open end of the socket; and (iii) a piston assembly vertically movable within the jar, the piston assembly including a platform and a rod projecting from an upper surface of the platform, the rod having a head at an end thereof distant from the platform, the piston being capable of receiving and supporting a stack of the applicator pads, and the head being releasably engageable with the ledge of the sockets, engagement of the head with the socket allowing the platform with pads to be raised to a top position.

* * * * *